United States Patent [19]

Garto et al.

[11] 4,036,497

[45] July 19, 1977

[54] AMUSEMENT APPARATUS WITH A BALL DROP AND A ROTATING RECEPTACLE

[76] Inventors: Joseph Benjamin Garto, 2240 E. 8th St., Brooklyn, N.Y. 11223; Anthony Garto, 2075 Shore Parkway, Brooklyn, N.Y. 11214

[21] Appl. No.: 620,426

[22] Filed: Oct. 7, 1975

[51] Int. Cl.[2] ..... A63F 7/02

[52] U.S. Cl. ..... 273/101; 273/105.2; 273/142 B; 273/142 E

[58] Field of Search ..... 273/144 R, 138 R, 142 R, 273/142 B, 142 D, 120 A, 86 R, 101, 102.1 R, 102.1 C, 102.2 R, 105 A, 138 A

[56] References Cited

U.S. PATENT DOCUMENTS

| | | | |
|---|---|---|---|
| 957,740 | 5/1910 | Burke | 273/120 A |
| 2,621,042 | 12/1952 | Stein | 273/144 R |
| 2,624,582 | 1/1953 | Wiser | 273/86 R |
| 2,960,336 | 11/1960 | Guensch | 273/138 A |
| 3,208,751 | 9/1965 | Kostka | 273/105.2 |
| 3,603,589 | 9/1971 | Sonntag | 273/105 A X |

FOREIGN PATENT DOCUMENTS

| | | | |
|---|---|---|---|
| 494,398 | 3/1930 | Germany | 273/142 B |

*Primary Examiner*—Richard C. Pinkham

*Assistant Examiner*—Vance Y. Hum

*Attorney, Agent, or Firm*—Martin Smolowitz

[57] ABSTRACT

An amusement apparatus to be played by several players, having as many playing stations as there are players. Each of the players participates by recordable and measurable action on his part with winning scores determined by a predefined risk-reward schedule. The playing stations are independently operable by each player to produce respective output signals that are intergradable with one another. Individual playing stations are formed of a base member having a first receptacle mounted above the base member provided with a plurality of predefined valued positions, each position being capable of receiving a token i.e. a ball, set in motion thereto by a player. A second receptacle depending from a frame positioned above the first receptacle initially positions the token above the first receptacle. Each player is provided with a release member for causing the token to be dropped out of the second receptacle and into the first receptacle. A display representing each of the predefined positions in the first receptacle is connected to each of the playing stations and is provided with indicia responsive to the position of each of the tokens after coming to rest in the respective first receptacle at each of the playing stations.

7 Claims, 5 Drawing Figures

FIG. 1
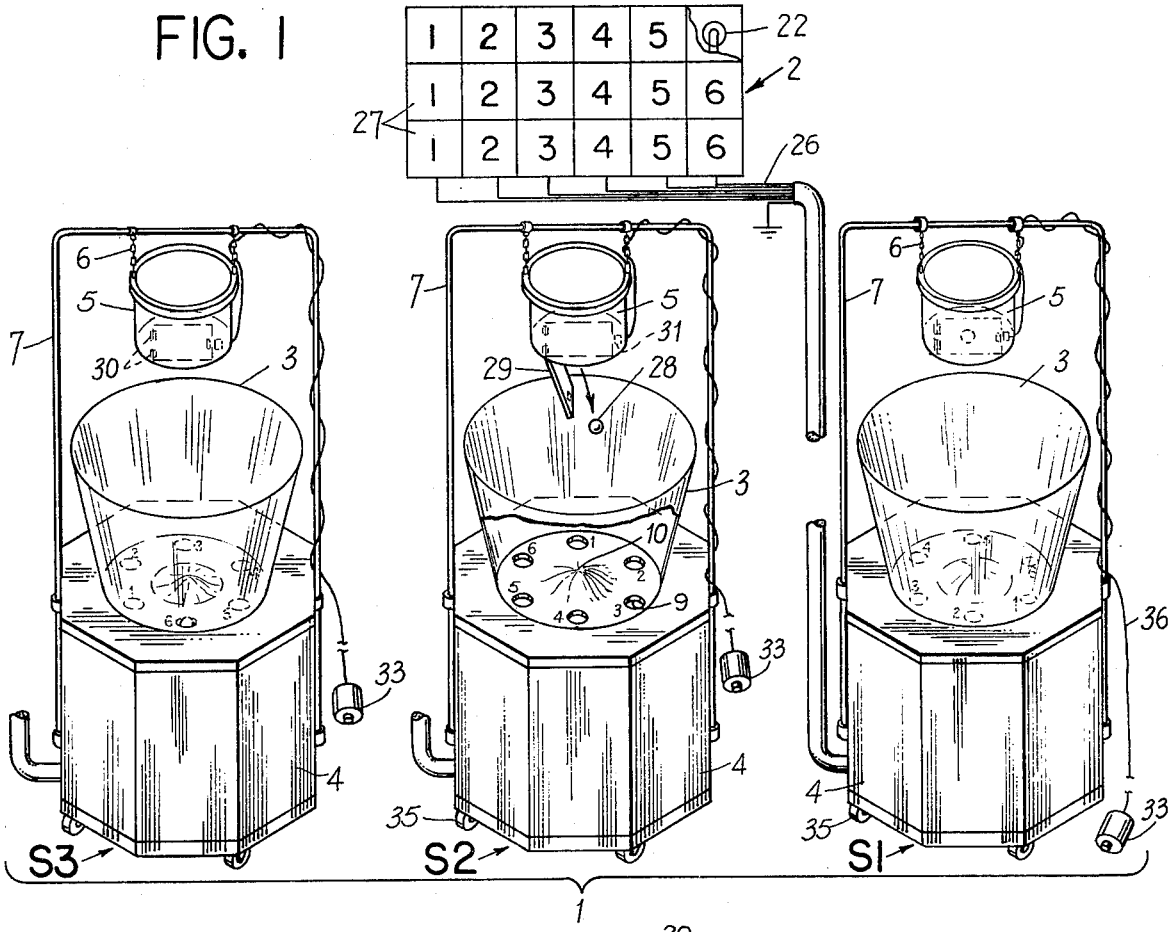
FIG. 3
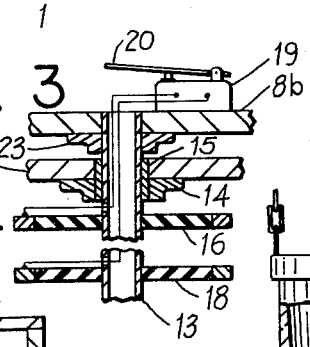
FIG. 5
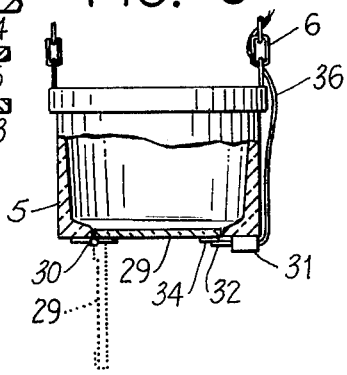
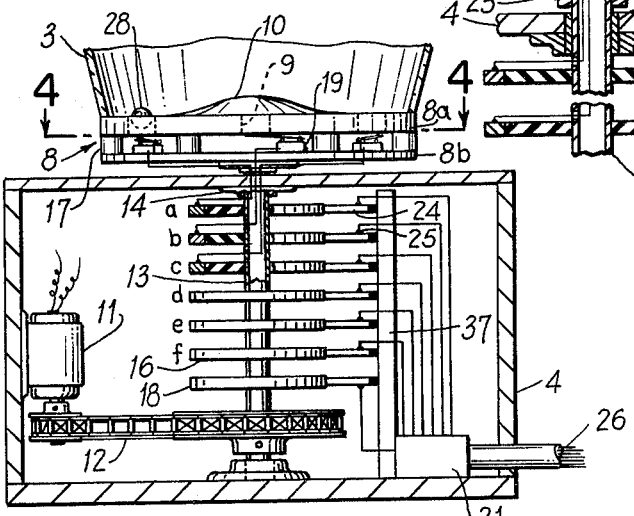
FIG. 2
FIG. 4
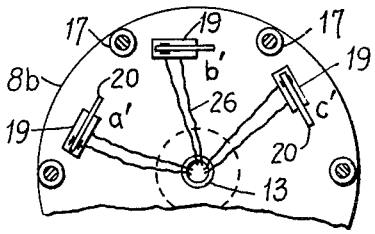

AMUSEMENT APPARATUS WITH A BALL DROP AND A ROTATING RECEPTACLE

The present invention is directed to an amusement apparatus which is intended to be operated by several persons during a given play. More particularly, the invention is directed to an arrangement whereby a plurality of targets are caused to fall by the action of several players, so as to energize a display in accordance with the position of the target at its rest position.

The use of a moving target, for an example, a ball or the like, caused to come to rest with respect to one of a plurality of predefined positions, each of which being disposed with respect to the point of origin of the target, is known to the prior art. The player of such a game, depending upon where the target comes to rest, is accorded a numeric or risk-reward value in accordance with the degree of difficulty in landing at a given position. For an example, an individual setting in motion a target i.e. a small ball in a revolving table having a plurality of numerical values associated with select locations is endeavouring to have the target as it is moving randomly, fall upon a designated location weighted in accordance with pre-determined risk-reward value. These types of prior art apparatuses can take the form of a roulette wheel or the like. In all cases, however, the player by his own action upon the apparatus is the only individual governing whether or not a particular combination of a moving target landing in a given location places it into a given risk-reward category. The very nature of the game has the built in limitation of not affording other players direct involvement by direct participation in contributing to the probability of obtaining a designated risk-reward combination.

The invention contemplates an amusement to be played by several players, having as many playing stations as there are players, each of said players participating by a discrete player action which is recordable and measured in accordance with a predefined risk-reward schedule, each of said stations being independently operable by a player to produce respective output signals that are intergradable with one another, said apparatus being provided with playing stations each including: a base member; a first receptacle mounted above said base member provided with a plurality of predefined valued positions having means for receiving a token set in motion thereto by said player: a second receptacle depending from hanging means positioned above said first receptacle for initially positioning said token; and display means connected to each of said playing stations having indicia means responsive to the position of said token at one of a plurality of said valued positions after coming to rest in said first receptacle.

Also within the scope of the invention is an amusement game having several active playing stations corresponding to the number of players engaged in playing the game, each of said stations being identical in operation and connected to a central display device for recording the action of each of said players, each player being provided with a ball for use with the game, being set into motion by the respective players at a time of their choosing, and each of said stations including: a base structure having a top and bottom; a centrally positioned shaft formed with a portion extending through the top surface of said base; motor means connected to said shaft through drive means for moving said shaft; a plurality of spaced apart insulated circular conductors each mounted on said shaft; a series of wipers and corresponding conductors mounted on an assembly disposed in said base structure, with each wiper being in intimate contact with an associated ring; a frusto-conically shaped receptacle mounted on that portion of said shaft extending from said base structure, being adapted to rotate in response to the movement of said shaft, said receptacle having a bottom assembly formed of a lower surface and a spaced apart upper surface, said lower surface being offset from said base structure to permit free-movement of said receptacle thereabout; a plurality of sensing switches mounted on the top of said lower surface in alignment with a corresponding number of openings provided in said upper surface, each of said switches being electrically connected to said spaced apart circular conductors through passage means in said shaft and to said central display device through said corresponding series of wipers and conductors; said upper surface having a centrally disposed guide means for urging the ball away from the center of said receptacle toward the outer portion of said upper surface, being provided with a plurality of spaced apart openings to receive the ball; an overhanging basket means mounted on frame means extending from said base above said receptacle, said basket means being adapted to receive and release the ball to be set in motion, and having a pivotable bottom member upon which said ball is maintained in the rest position until set in motion by said player via activation of energizable switch means for releasing said bottom member from the basket and setting said ball in flight toward said receptacle; and display means having indicia means corresponding in number to each of said openings in said receptacle, being electrically connected to each of said switches for energization in response to the presence of said ball at a designated opening in the bottom assembly of said receptacle.

It will be understood that the apparatus as herein described being employed with targets caused to be set in motion with electrically energized means by the player, can readily be employed with a mechanical type of actuating member for securing a designated response.

Accordingly, it is the main object of the present invention to provide a game suitable for play by several persons adapted to provide a series of numeric combinations which have an associated risk-reward relationship.

Still another object of the present invention is to provide an apparatus including several operable stations, each of such stations being energized by separate players for urging a target to be placed into motion to ultimately come to rest into one of several predefined locations.

Still a further object of the present invention is to provide an apparatus operable in combination by several players where the highest risk-reward combination is a function of the at rest position of several targets which come to rest at numerically valued locations.

Still a further object of the present invention is to provide an apparatus actuated by several players for causing a plurality of targets to energize associated switch means connected to display circuitry corresponding to the position of the respective targets at designated locations.

Other objects and advantages of the invention will become apparent upon reading the detailed specification hereinafter following and by referring to the drawings annexed hereto.

A suitable embodiment of the invention is shown in the attached drawings herein:

FIG. 1 is a schematic illustration partially in prospective showing three stations of operation and a display panel.

FIG. 2 is a partial cross-sectional view of one of the stations in FIG. 1 illustrating the drive and electrical system.

FIG. 3 is a partial cross-sectional view of a central portion of FIG. 2.

FIG. 4 is a partial top view taken along line 4—4 in FIG. 2.

FIG. 5 is a partial sectional view of one of the receptacles illustrated in FIG. 1.

Numerical references are employed indicating various parts shown in the drawings and like numerals indicating like parts throughout the various figures of the drawings.

In accordance with FIG. 1, the apparatus 1 of the invention employs a series of independently operated stations, S1, S2, S3 and a display panel 2 connected thereto, each of the stations are basically comprised of three principle components; a rotatable drum 3, a base 4 and a receptacle 5. The rotatable drum 3 is mounted upon the base 4 through a rotatable shaft and the receptacle 5 is disposed above the rotatable drum 3 being adapted to cooperate with the drum 3. The receptacle 5 is suspended from an appropriate line, such as a pair of chains 6 which are mounted upon a frame 7 extending up from base 4 above the drum 3 for a height sufficient to enable the receptacle 5 to be centrally positioned above drum 3. The drum 3 is preferably frusto-conical in shape, though it may be generally cylindrical, and is entirely opened at the top end and having an opposite lower section 8 with an upper member 8*a* and lower member 8*b* (see FIG. 2). A plurality of symetrically disposed openings 9 are provided in upper member 8*a;* for illustrative purposes, these openings are shown to be six in number. The center area of the upper member 8*a* is provided with a sloping protuberance 10 which is integrally formed of the upper member 8*a* extending upwardly in a direction of the receptacle 3 and sloping into the direction of openings 9. The rotatable drum 3 is mounted above base 4 in a manner to be described hereinafter, so as to enable the drum 3 to rotate about its vertical axis.

The base 4 has mounted therein an electrically driven motor 11 connected to a suitable drive 12, such as a chain and sprocket, on through to a hollow shaft 13 connected to the drum 4 and lower member 8*b* of lower section 8. The shaft 13 is journalled at opposite ends to the drum 4 by suitable flange members 14 and bearings 15. At its upper position, shaft 13 extends out of base 4 and into the lower member 8*b* where it is positioned in place by flange 23 at the lower surface of lower member 8*b*. The respective upper member 8*a* and lower member 8*b* are held in position spaced from one another by suitable spacers 17, other suitable spacing members such as discs (not shown) positioned about the inner periphery of lower member 8*b* can be employed as well.

The shaft 13 is provided with a series of spaced apart fixedly attached insulated metallic rings 16 which rotate in accordance with the movement of shaft 13. The lower most ring 18 functions in a manner different to the other rings 16. Each of the openings 9 provided in upper member 8*a* of rotatable drum 3 have associated therewith respective fixedly positioned normally open switches 19 mounted in proximity to each opening 9 on lower member 8*b*.

As shown in more detail in FIGS. 2 and 3, the lower section 8 of the rotatable drum 3 is essentially a composite member having an upper member 8*a* and a lower member 8*b* each being held spaced apart from one another by suitable spacers 17. The upper member 8*a* is provided with the series of equally spaced openings 9, where for each openings there is a corresponding switch 19 disposed beneath each of the openings 9 having contacts 20 which are in alignment with each of the respective openings 9. Since each station S1, S2, S3, is provided with six openings 9, it follows that there are a like number of switches 19. Each switch is connected to an associated insulated ring 16, i.e., *a, b, c,* etc. and to ring 18, such electrical wiring taking place through a passage way in shaft 13 (see FIG. 4). Ring 18 provides the control voltage from terminals 21 for energizing the respective lamps 22 in display 2 through switch 19 and associated rings 16, i.e. *a, b, c,* etc. via corresponding wiper 24 and contact 25 through wires 26 connected to lamps 22. Each ring 16 is provided with associated wiper members 24 positioned on a wiper mounting assembly 37 and corresponding insulated contacts 25 that are electrically connected to the bulbs 22 of display panel 2 through wires 26. The display panel 2 includes a plurality of positions 27 each illuminated by a separate bulb 22 corresponding to a switch 19 at each station. The respective bulbs 22 are electrically connected in parallel to a common ground on the return side. The hot lead of each lamp being electrically connected through wires 26 to an associated ring 16, i.e. *a, b, c,* etc. corresponding to a respective switch 19, i.e. *a', b', c'* (see FIG. 4).

For example, when employing the three stations S1, S2, S3 of the present invention, each of which having six openings 9, it follows that eighteen positions are to be found on the display panel 2.

During operation of the invention 1, each station S1, S2, S3, is caused to function by having an operator energize electric motor 11 in a conventional manner; this causes shaft 13 to rotate through a drive 12. Drum 3 is urged to rotate through drive 12 acting on shaft 13, since the lower member 8*b* of drum 3 is directly connected to shaft 13 (see FIG. 3). The lower surface of member 8*b* is sufficiently spaced above the top of base 4 to enable free and uninhibited rotation by the drum 3. The plurality of rings 16 and 18 are directly mounted on and spaced from one another along the length of the shaft and move in concert with shaft 13. Corresponding insulated wipers 24 and associated contacts 25 are fixedly disposed on mounting assembly 37 are in proximity to rings 16 and 18 permitting continuous contact between wipers and rings during the rotation of shaft 13.

As a given target 28 is caused to fall into the rotating drum 3 of a station, i.e. S2, it eventually seats into one of six possible openings 9 and the corresponding normally open switch 19 i.e. *a',b', c',* etc. is urged into the closed position by the action of the target 28 on the switch contacts 25 causing a corresponding ring 16, i.e. *a, b, c,* etc. connected to the switch 19 to become energized. At that instant the circuit to the display panel 2 is closed and an electrical signal is caused to be transmitted to the associated display position 27 on the display panel as explained above.

The display panel 2 can take a number of different forms, but for illustrative purposes and simplicity sake, it is shown as having different assigned numeric values which light up in response to each target 28 at a respective station S1, S2, S3. In affect the contacts 25 of normally opened switches 19 will close only when the moving target 28 is caused to be seated in opening 9 enabling the circuit to the display panel 2 to close; any intermittent movement of a target 28 into and out of an opening 9, will not energize the position 27.

The receptacle 5 as shown in FIG. 5, is provided at its lower surface with a pivotable end member 29 which can pivot about point 30. The end member 29 is positioned in place by means of a solenoid 31 having a spring biased plunger 32 which is normally in the extended position. The solenoid 31 is electrically connected to a hand operated switch 33 and is responsive to actuation of the switch 33. The plunger 32 is caused to remain in the normally extended position for engagement with the pivotable end member 29 at stop member 34 until the hand switch 33 is energized. At this instant, the plunger 32 retracts and the pivotable end member 29 pivots about pivot point 30, thereby causing the previously placed target 28 which is at rest in the receptacle 5, to fall through the distance between the rotatable drum 3 and the receptacle 5, (see FIG. 1). After the target 28 has fallen, the pivotable end member 29 is placed back in its start position by the operator and is once again held in place by plunger 32 of solenoid 31. The plunger 32 may have a bevel at its working end so as to enable latching with the pivotable end member 29 at stop member 34.

As the target 28 is caused to fall out of receptacle 5 and descends into rotatable drum 3, the path of travel of the target 28 within the rotating drum 3 is random; with such target 28 capable of being deflected by co-action with the walls of the rotating drum 3 and by protuberance 10 which is sloping away from the center of upper member 8*a,* in a direction of openings 9. The operator for his part, would tend to release the target 28 when in his opinion the drum 3 has rotated to a point which would enable the target 28 to seat into opening 9 of his choice. Once such target 28 seats in an opening 9, the corresponding normally open switch 19 energizes the display panel 2 in a manner described above.

It is preferred that the rotatable drum 3 be frusto-conically shaped, since it has been found that such a shaped drum operates satisfactorily and materially adds to the manner in which the target 28 travels during its movement into a given opening 9.

If instead of an electrically energized solenoid 31, it were decided to employ purely mechanical means for releasing the pivotable end member 29, a latch operated releasable member or other mechanical means could be employed to cause the target 28 to fall into the rotating drum 3.

Each of the stations S1, S2, S3, is intended to be portable and capable of being moved from location to location on suitable rollers 35. Each operator at one of the stations S1, S2, S3 by the release of target 28 from receptable 5 into the rotatable drum 3 and its subsequent seating in opening 9, completes the circuit to a corresponding section of the display panel 2. The number of stations are illustrated as three in number, however, this can be varied without departing from the spirit of the invention. Obviously, the display panel 2 configuration is constructed to reflect the number of stations being employed. As the number of stations are changed so is the risk-reward relationship of the combinations possible on the panel 2. Obviously, the more difficult to obtain combinations arrived at by the energization of different switches in response to respective targets for each of the stations S1, S2, S3, will carry with it, a higher reward value as compared to those combinations which are more readily obtainable.

To add to the overall environment in which the apparatus 1 is employed, the switch 33 can be placed at the end of an electrical cord 36 of a suitable length enabling it to be moved within a wide area for energization by those within the sweep of its length.

It is preferred that the rotatable drum 3 be constructed of a suitable clear high impact material, such as Plexiglass or Lucite, thereby enabling each of the targets 28 as they fall from the receptacle 5 into the rotating drum 3 to be seen and its movement being visually monitored as it seats into one of the six openings 9. The rotatable drum 3 can also be constructed of wire mesh material.

Once the target 28 is released, it falls and seats into the opening 9, the position is displayed on panel 2 and recorded. After this takes place, an attendant servicing the stations S1, S2, S3, will remove the targets from the drum 3; reset the pivotable end member 29; and place such targets 28 into the receptacle 5 for the next operation. Participants and operators can each be provided with a program card containing field of predefined values enabling the various positions to be recorded and measured against a predefined risk-reward relationship grid. The sequence in which the respective targets 28 at each of the stations S1, S2, S3 are released is not critical, since each opening 9 has its own associated switch 19 connected to a display position 27 and consequently, the panel lamps 22 will energize at the instant the normally opened switches 19 are closed and the circuit is completed.

It will be understood that other and further forms of the invention may be devised without departing from the spirit and scope of the appended claims.

What we claim:

1. An amusement apparatus to be played by at least one player at respective playing stations, each of said players participating by discrete player action which is recordable and measured in accordance with a predefined risk-reward schedule, each of said respective stations being independently operable by a player to produce output signals that reflect a measure of success with respect to one another in accordance with said risk schedule, said apparatus having playing stations each including: a base member, a first frusto-conically shaped rotatable receptacle mounted above said base member having a lower member with a plurality of equally spaced valued receiving means for receiving token means set in motion by said player, said first receptacle being further defined by an integrally formed guide means centrally disposed therein for directing said moving token means to said receiving means; a second receptacle positioned above said first receptacle and in spaced relationship to said guide means for initially positioning said token means with respect to said first receptacle; said second receptacle being provided with a releaseable lower portion having associated release means for pivoting said lower portion about a point in response to energization of switch means acting upon said release means for releasing said lower portion of said second receptacle, causing said token means to move from said second receptacle toward said first receptacle; and display means connected to each of said operating stations having indicia means responsive to the rest position of said token means at one of a plurality of said valued positions in said first receptacle after release from said second receptacle.

2. An amusement apparatus as claimed in claim 1, wherein: said switch means being provided with associated retractable normally extended spring loaded plunger means, for fixedly positioning said lower portion of said second receptacle, said plunger means being retractable in response to player operation for causing said lower portion of said second receptacle to open, thereby permitting said token means to fall freely into said first receptacle.

3. An amusement apparatus as claimed in claim 1, wherein: said first receptacle being formed of a lower member having first and second spaced apart co-operating sections, said first section being defined by a centrally disposed upwardly extending protuberance in axial alignment with said lower portion of said second receptacle, and a plurality of equally spaced openings disposed about and extending away from said protuberance; said second section having mounted thereon sensing means corresponding in number to and in alignment with said spaced openings in said first section, said sensing means being energized in response to the presence of token means.

4. An amusement game as claimed in claim 1, wherein: said respective players being provided with energizing means actionable upon said second receptacle for effectuating output indicia as a function of a cumulative display defining the position of said token means in respective valued openings surrounding said centrally disposed guide means to enable determination of a designated output in accordance with a predefined risk-reward relationship.

5. An amusement game having several active playing stations corresponding to the number of players engaged in playing the game, each of said stations being identical in operation and connected to a central display device for recording the action of each of said players, each player being provided with a ball for use with the game, being set into motion by the respective players at a time of their choosing, and each of said stations including: a base structure having a top and bottom; a centrally positioned shaft formed with a portion extending through the top surface of said base; motor means connected to said shaft through drive means for moving said shaft; a plurality of spaced apart insulated circular conductors each mounted on said shaft; a series of wipers and corresponding conductors mounted on an assembly disposed in said base structure, with each wiper being in intimate contact with an associated ring; a frusto-conically shaped receptacle mounted on that portion of said shaft extending from said base structure, being adapted to rotate in response to the movement of said shaft, said receptacle having a bottom assembly formed of a lower surface and a spaced apart upper surface, said lower surface being offset from said base structure to permit free-movement of said receptacle thereabout; a plurality of sensing switches mounted on the top of said lower surface in alignment with a corresponding number of openings provided in said upper surface, each of said switches being electrically connected to said spaced apart circular conductors through passage means in said shaft and to said central display device through said corresponding series of wipers and conductors; said upper surface having a centrally disposed guide means for urging the ball away from the center of said receptacle toward the outer portion of said upper surface, being provided with a plurality of spaced apart openings to receive the ball; an overhanging basket means mounted on frame means extending from said base above said receptacle, said basket means being adapted to receive and release the ball to be set in motion, and having a pivotable bottom member upon which said ball is maintained in the rest position until set in motion by said player via activation of energizable switch means for releasing said bottom member from the basket and setting said bail in flight toward said receptacle; and display means having indicia means corresponding in number to each of said openings in said receptacle, being electrically connected to each of said switches for energization in response to the presence of said ball at a designated opening in the bottom assembly of said receptacle.

6. An amusement game of chance employing several players of each of whom plays at an identical station and each of which includes: token means disposed in a receptacle means, said receptacle means being formed of a pivotably releaseable retaining means, a rotatable receiving means disposed below said receptacle means, having a plurality of identifiable positions for receiving said token means; electrical switch means disposed in each of said positions for energizing display means connected thereto and corresponding to the respective position on said receiving means; release means governed by each of said players for releasing said token means from said retaining means, whereby said token means settles at respective positions in said rotating receiving means through the urging of a guide means centrally disposed in said receiving means, to thereby energize said electrical switch means.

7. An amusement game of chance as claimed in claim 6, wherein: each of said players are provided with individual token release means for energization at will by said players, causing respective token means to fall from each of said retaining means into associated receiving means mounted on a base and being rotated at a speed sufficient to be guided by a centrally disposed hemispherical guide means formed upon the lower surface of said receiving means, for causing said token means to come to rest at one of several electrical energizable switch means, each player having a corresponding array of switch means connected to indicia means energizable as said token means energizes said switch means; said indicia means being provided for each of said players, whereby the cummulative total reflecting corresponding positions of said token means in each of said retaining means, provides a total output measured in terms of the cumulative degree of difficulty in attaining given output indicia.

* * * * *